United States Patent [19]

Yamamoto et al.

[11] Patent Number: 4,694,525

[45] Date of Patent: Sep. 22, 1987

[54] HAIRBRUSH

[75] Inventors: Hiromi Yamamoto, Sakura; Miho Imai, Ichikawa; Noboru Suzuki, Tokyo, all of Japan

[73] Assignee: Kao Corporation, Tokyo, Japan

[21] Appl. No.: 782,248

[22] Filed: Sep. 30, 1985

[30] Foreign Application Priority Data

Oct. 8, 1984 [JP] Japan ..... 59-152133[U]

[51] Int. Cl.[4] ..... A46B 9/02

[52] U.S. Cl. ..... 15/160; 15/186; 15/195; 132/85

[58] Field of Search ..... 15/160, 186, 187, 188, 15/195; 132/85, 150

[56] References Cited

U.S. PATENT DOCUMENTS

| | | | |
|---|---|---|---|
| 2,633,591 | 4/1953 | Servilla | 15/160 |
| 3,651,532 | 3/1972 | Wettburg | 15/186 |
| 4,118,823 | 10/1978 | Axelrod | 15/186 X |
| 4,161,050 | 7/1979 | Sasaki et al. . | |
| 4,217,915 | 8/1980 | Gress et al. | 132/85 X |
| 4,417,595 | 11/1983 | Okumura et al. . | |
| 4,475,261 | 10/1984 | Okumura et al. . | |

FOREIGN PATENT DOCUMENTS

| | | | |
|---|---|---|---|
| 954436 | 6/1949 | France | 132/150 |
| 1124671 | 7/1956 | France | 15/160 |

*Primary Examiner*—Peter Feldman

*Attorney, Agent, or Firm*—Flynn, Thiel, Boutell & Tanis

[57] ABSTRACT

In a hairbrush having a base portion for implantation of bristles and a grip portion, bristles are implanted to extend from a center axis in the radial direction viewed in a cross-sectional plane of said implantation portion, in such a fashion that the curve defined by the tips of said bristles describes an arcuate shape, the curve defined by the tips of said bristles is arcuately recessed in a cross section in the longitudinal direction, and the axis of rotation of said grip portion in the longitudinal direction is in parallel with the center axis of said bristles and is spaced apart therefrom by 5 to 15 mm on the side of said bristles.

7 Claims, 4 Drawing Figures

HAIRBRUSH

FIELD OF THE INVENTION

This invention relates to a hairbrush, and more particularly to an improvement in or relating to a hairbrush of a type in which bristles are implanted in a radially dispersed arrangement to an implantation portion of a base so as to provide a hairbrush which has an excellent hair-holding property when used for a permanent wave or straight hair and moreover has extremely good separability for blow drying.

BACKGROUND OF THE INVENTION

A conventional hairbrush has a construction in which bristles are implanted in a zigzag pattern in a bristle implantation portion of a base, which is generally referred to as a "handle", around its entire periphery or a part of the periphery.

However, a roll brush (a hairbrush of a type in which bristles are implanted around its entire periphery) using animal hairs as the bristles has a large number of bristles per implantation hole. For this reason, the hair is difficult to comb when making a desired hair style when blow drying, the bristles have a low hair-holding property and curls can not be made sufficiently. Furthermore, since excess hair is easily entangled, it is pulled to spoil the skin, so that the feel of use of the hairbrush is not good.

On the other hand, a roll brush of a type in which one molded bristle is implanted to each hole and a roll brush of a type in which two to four filamentary plastic bristles are implanted in each hole have been proposed in place of the roll brush using animal hair. However, they are not free from the problems of the entanglement of excess hair and bad feel of use, and can not essentially solve the problems of the roll brush using animal hairs. A so-called "half-round brush", in which the bristles are implanted around about a quarter of the periphery, is easy to use and exhibits less entanglement of the hairs, but involves the problems that the hair-holding property of the bristles is low and the capacity of forming the curls as well as the capacity of extending the curls of the permanent wave hair are low.

As described above, conventional hairbrushes, particularly those hairbrushes which are used for blow drying for finishing a desired hair style while drying the hair with a dryer, have not yet been fully satisfactory, and demands for improved hairbrushes have been strong.

SUMMARY OF THE INVENTION

The inventors of the present invention have made intensive studies in search of hairbrushes which satisfy all of the requirements for the curl formation capacity, the curl extending capacity for permanent wave hair and the high performance, and have found that a hairbrush, in which the tips of bristles implanted in a radially dispersed arrangement to an implantation portion of a base describe a specific curvature, has an excellent hair-holding property when used for the permanent wave or straight hair, and exhibits extremely good hair separability during blow dry. Thus, the present device is completed on the basis of the finding described above.

In a hairbrush according to the invention, having a base consisting of an implantation portion to which bristles are to be implanted and a grip portion continuing the implantation portion, the bristles are implanted dispersed from a center axis in the radial direction, viewed in a cross-sectional plane of said implantation portion, in such a fashion that the curve defined by the tips of said bristles describes an arcuate shape, the curve defined by the tips of said bristles is arcuately recessed when viewed in a cross section in the longitudinal direction, and the axis of rotation of said grip portion in the longitudinal direction is parallel with the center axis of said bristles and is spaced apart therefrom by 5 to 15 mm on a side thereof toward said bristles.

In a preferable embodiment of the inventive hairbrush, the cross-sectional plane of the implantation portion is the same on any section, that is, uniformly shaped on any section thereof. It is also preferable that the implantation surface has an arcuate shape having a radius of 10 to 30 mm in a cross-sectional plane of the implantation portion.

In the hairbrush of the present invention, the curve defined by the tips of the bristles describes an arcuate shape when viewed in the section in the longitudinal direction, and the radius of this arcuate shape is preferably from about 300 to about 500 mm. To accomplish the objects described above, it is preferred also that in the hairbrush of the present invention, the axis of rotation of the grip portion in the longitudinal direction is parallel with the center axis of the bristles and is set apart from the latter on the side of the bristles, and the bristles are implanted at those points at which the distance between the implantation points of the bristles implanted at end portions, in the cross-sectional plane of the implantation portion, and the axis of rotation of the grip portion is smaller than the distance between the implantation points and the center axis of the bristles. Preferably, the center axis of the bristles is set apart by 5 to 15 mm from the axis of rotation of the grip portion. The cross-sectional surface of the bristle implantation plane of the implantation portion is preferably arcuate.

In the hairbrush of the present invention, the bristles and the handle may be molded integrally, but from the aspect of production efficiency, it is advisable to fit a bristle sheet, which is produced by implanting the bristles into a sheet or by integrally molding the bristles with the sheet, to the handle of the hairbrush.

DETAILED DESCRIPTION

Hereinafter, an embodiment of the inventive device will be described with reference to the accompanying drawings.

Figure 1:
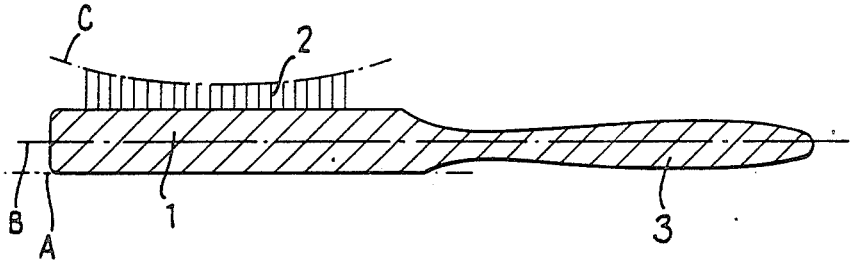
FIG. 1 is a sectional view when a hairbrush of the present invention is cut off in the longitudinal direction.
Figure 2:
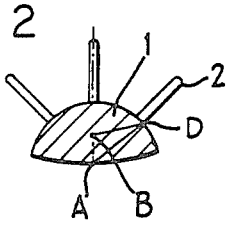
FIG. 2 is a transverse sectional view of its implantation portion.
Figure 3:
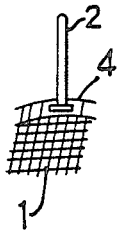
FIGS. 3 and 4 are sectional views showing two alternative implantation arrangements for the bristles at the implantation portion.

FIG. 1 is a longitudinal sectional view produced when the hairbrush of the present invention is cut off in the longitudinal direction, and FIG. 2 is a transverse sectional view of the implantation portion of the hairbrush. In the drawings, reference numeral 1 represents the base of the implantation portion. The cross-sectional plane of the implantation surface of the base 1 is arcuate as shown in FIG. 2, and the bristles 2 are dispersedly implanted in the implantation surface to extend from the center axis A in a radial direction so that the curve defined by the tips of the bristles describes an arcuate shape. Moreover, the longitudinal curve C defined by the tips of the bristles is arcuately recessed as shown in FIG. 1, and the radius of this curvature is suitably from 300 to 500 mm, and preferably from 350 to 450 mm. Since the section C is thus arcuately recessed, the bristles can securely catch the hairs.

Furthermore, the axis of rotation B of the grip portion 3 in the longitudinal direction is parallel with the center axis A of the bristles 1 and 2 and is spaced apart therefrom on the side of the bristles as shown in FIGS. 1 and 2, and this distance is preferably within the range of 5 to 15 mm.

The cross-sectional shape of the base 1 at the implantation portion is preferably semi-circular or semi-elliptic so that its center is the center axis A of the bristles and the bristles extend from it in the radial direction. In the preferred embodiment shown in FIG. 2, the base has thereon an implantation surface which has the bristles implanted therein and which in cross-section is of semi-circular shape and preferably has a radius in the range of 10 to 30 mm.

The bristles 2 are suitably implanted at those portions at which the distance between the implantation points D of the bristles implanted at the right and left end portions and the axis of rotation B of the grip portion 3 is smaller than the distance between the implantation points D and the center axis A of the bristles, that is, at the portions at which the relation $AD > BD$ is satisfied as shown in FIG. 2.

In the present device, the axis of rotation of the grip portion in the longitudinal direction is set apart from the center axis of the bristles on the side of bristles, and the range of implantation of the bristles is limited as described above. Accordingly, the radius of rotation of the hairbrush is reduced and the hairbrush is easier to rotate so that the operability and hair-holding property of the hairbrush can further be improved.

Figure 4:
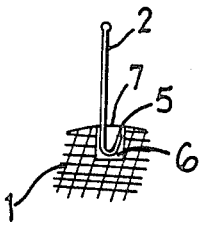

In the present invention, the term "implantation" means not only the implantation itself of the bristles, but represents also an implantation portion which is equipped with the bristle or bristles. Therefore, the implantation method includes not only such an implantation method which directly implants the bristle 2 into the implantation hole 6 formed at the implantation portion of the base by a pin 7 as shown in FIG. 4, but also such a method which fits and implants the bristles to a support 4 such as a flexible sheet or plastic plate equipped with the implantation hole, and then winds the support 4 around the implantation portion of the base in such a manner as to form the implantation portion 1. Filaments can be used in place of the pins 7. Moreover, a known implantation method which produces the hairbrush as a whole by integral molding can of course be employed.

In order to protect the hair more effectively, it is preferred that one (5) of the ends of the bristle is not exposed to the base surface, as shown in FIG. 4.

In the present device, The shape of the base 1 is not limited to a particular configuration. Preferably, the cross-sectional shape of the base at the implantation portion is arcuate. If the radius of the implantation portion is from 5 to 25 mm, the hairbrush is easy to use. Similarly, the thickness of each bristle is preferably from 0.5 to 2 mm, and its exposed length, from 10 to 25 mm.

The base and the bristle may be made of plastic, metal, or the like, and a wooden handle can also be used.

To obtain an easy-to-use hairbrush, the implantation density of the bristles is 4 to 40 pcs/cm$^2$ and the length of the implantation portion is within the range of 50 to 100 mm. To reduce the brushing force, one bristle is preferably implanted into one implantation hole, but the number of bristles may be from 1 to 40 per implantation hole.

As shown in FIGS. 1 and 2, the hairbrush of the present invention changes the height of the bristles from the implantation portion to define a curvature, so that the hairbrush exhibits the excellent hair retaining property and good separability of the hair when used for the permanent wave hair or the straight hair, and is extremely convenient to use.

The embodiments of the invention in which an exclusive property or provilege is claimed are defined as follows:

1. A hairbrush, comprising a base and a plurality of bristles, said base including an implantation portion on which said bristles are supported and an elongate grip portion projecting outwardly from said implantation portion; wherein said bristles extend generally radially outwardly with respect to a center axis and, viewed in a cross-sectional plane of said implantation portion perpendicular to said center axis, have tips at outer ends thereof which define an arcuate curve substantially concentric to said center axis; wherein said tips of said bristles, viewed in a cross-sectional plane of said implantation portion containing said center axis, define an arcuate curve having a centerpoint on a side of said bristle tips remote from said base; and wherein said grip portion has an axis of rotation which extends centrally longitudinally therethrough, which is parallel to said center axis, and which is spaced by a distance in the range of 5 to 15 mm from said center axis, said center axis being on a side of said axis of rotation remote from said bristles.

2. The hairbrush as defined in claim 1, wherein, in each cross-sectional plane of said implantation portion perpendicular to said center axis, the tips of the bristles define an arcuate curve substantially concentric to said center axis.

3. The hairbrush as defined in claim 1, wherein said implantation portion has an arcuate implantation surface which is on a side thereof facing said bristles and which, viewed in a cross-sectional plane of said implantation portion perpendicular to said center axis, has a radius in the range of 10 to 30 mm.

4. The hairbrush as defined in claim 1, wherein said implantation portion has first and second end portions spaced in a direction parallel to said center axis, wherein said bristles are each implanted at an implantation point and wherein a distance from each said implantation point on said first and second end portions to said axis of rotation is smaller than a distance from such implantation point to said center axis.

5. The hairbrush as defined in claim 1, wherein said implantation portion of said base, viewed in a cross-sectional plane perpendicular to said center axis, has a shape which is approximately semi-circular.

6. The hairbrush as defined in claim 1, wherein said base includes a plurality of implantation holes in said implantation portion thereof, and wherein each said bristle has an end implanted in a respective one of said implantation holes by means of a pin disposed in such hole.

7. The hairbrush as defined in claim 1, wherein said base includes an elongate flexible element which has one end of each said bristle supported therein and which is wound around said implantation portion of said base.

* * * * *